US005755399A

United States Patent [19]

Halvonik et al.

[11] Patent Number: 5,755,399

[45] Date of Patent: May 26, 1998

[54] COMPUTER FORM WEB DOCUMENT UNFOLDING AND FEEDING ASSISTANCE SYSTEM

[75] Inventors: Mark R. Halvonik, Rochester; James D. Walsh, Henrietta; Mary Beth Bordeau, Webster, all of N.Y.

[73] Assignee: Xerox Corportion, Stamford, Conn.

[21] Appl. No.: 837,485

[22] Filed: Apr. 18, 1997

[51] Int. Cl.[6] ..... B65H 57/00; G03G 15/00; B41J 11/26

[52] U.S. Cl. ..... 242/615; 399/375; 399/384; 400/613.2

[58] Field of Search ..... 242/615; 226/74; 400/613.2; 399/375, 384

[56] References Cited

U.S. PATENT DOCUMENTS

| | | | |
|---|---|---|---|
| 2,061,595 | 11/1936 | Sherman | 400/613.2 |
| 3,232,407 | 2/1966 | Drescher | 400/613.2 |
| 4,059,256 | 11/1977 | Palmer | 400/613.2 X |
| 4,086,007 | 4/1978 | Smith et al. | 399/384 |
| 4,300,710 | 11/1981 | Du Bois et al. | 226/74 |
| 5,152,514 | 10/1992 | Meetze . | |
| 5,317,365 | 5/1994 | Tschiderer et al. | 399/384 X |
| 5,630,511 | 5/1997 | Bose | 400/613.2 X |

OTHER PUBLICATIONS

U.S. Statutory Invention Registration No. H17, published Feb. 4, 1986. Inventor: Wenthe, Jr., Assignee: Xerox Corp. Appl. No. 526,730.

*Primary Examiner*—Michael Mansen

[57] ABSTRACT

In a document feeding system for unfolding and feeding an elongated web multi-sectional computer form (CF) document from one end of a fan-folded stack in a document input stacking area to an imaging station, a CF document unfolding assistance system is provided by a mounting system cantilever mounting from behind the fan-folded stack a single smoothly radiused cylindrical CF unfolding assistance bar, with a radius of approximately 5 to 8 mm, rotatable between a completely non-obstructing rear storage position and a stationary operating position overlying the document input stacking area, and with a detent system for detaining the CF unfolding assistance bar in the operating position, in which this CF unfolding assistance bar is in a fixed position spaced intermediately above the CF web stack by about 5 cm and extending horizontally over the stack substantially perpendicular to the feeding direction in a position which is spaced closer to the one end of the stack than its opposite end, approximately 11 cm from that one end; for otherwise unobstructed loading, unfolding and feeding of the CF document up and over the unfolding assistance bar towards the imaging station with reduced forces and improved control.

7 Claims, 5 Drawing Sheets

COMPUTER FORM WEB DOCUMENT UNFOLDING AND FEEDING ASSISTANCE SYSTEM

Disclosed in the embodiments herein is an improved system for the unfolding and feeding of elongate web multi-sectional computer form documents from a conventional fan-folded stack thereof placed in an input stacking area to be fed to an imaging station. This disclosed system is simple, low-cost, and easy to use, yet provides improved reliability and other advantages in unfolding and feeding of the fan-folded stack of such documents.

Computer form ("CF") feeding ("CFF") presents particular problems in unfolding and feeding such elongate CF web documents reliably and without tearing the web. Typically, the CF web is multi-sectional, by being provided with spaced transverse lines of partial cuts or perforations between the web sections or segments, which are often called "burst lines" since they can be conveniently torn along those lines. That is where the CF web is typically folded, into what is called a fan-fold or Z folded stack. Both the cuts or perforations and the folding weaken the CF web at those burst line positions, which can cause inadvertent separations or tearing along those lines during web feeding if there is excessive web feeding force. The burst line folds can also increase web feeding noise. Also, unless the CF web is carefully unfolded from its fan-folded stacking position, the web can jam or provide excessive resistance to the downstream feeding device. For feeding for imaging, the CF web feeding is typically incremental, with rapid accelerations and decelerations, since typically the web is imaged one segment at a time. Even if the CF web is fed evenly, as for continuous velocity line scanning type imaging, the unfolding system can produce considerable noise in the process of unfolding the fan-folded web. It is desirable to overcome, to the extent possible, all of these problems, without a complex and expensive web feeding system.

It is also very desirable to provide a CF web feeding accessory which is fully compatible with, and does not obstruct in any way, the normal feeding of normal individual sheet documents to a copier, scanner, or other imaging system.

The disclosed CFF system provides a computer form web fan-folded document unfolding and feeding assistance device which provides the above and other features. In particular, it provides for the computer form web document to be fed the input of an existing document handler or feeder with low noise and high reliability, yet is very low cost, simple, and intuitively easy to use. Furthermore, the CFF system of the disclosed embodiment has both an operating position and a repositionable non-obstructing storage position, and ease and simplicity of operator movement therebetween. In that storage position it is conveniently fully out of the way at the rear of the entire system. A simple manual movement moves the system to its operating position, and even there, it provides unobstructed frontal access for the stacking and feeding of the documents. The disclosed embodiment is readily mounted at low cost to various document handlers, the top covers of various imaging systems, or interposer modules, or the like, without decreasing the available working area or work surfaces of such units. This CF feeding assistance unit of the embodiment herein can be mounted completely at the rear of the document feeder and/or other top cover units of various conventional imaging apparatus, in various positions, and mounting at a single simple cantilever pivotal mounting position.

By way of background and further explanation of the particular problems and difficulties of feeding and handling computer form web documents, there is noted U.S. Pat. No. 5,152,514 issued Oct. 6, 1992 to Murray O. Meetze (D/90134); and U.S. Statutory Invention Registration No. H17, published Feb. 4, 1986 by Stephen J. Wenthe, Jr. (D/83159). Various other computer form feeding prior art is cited and discussed therein.

A specific feature of the specific embodiment(s) disclosed herein is to provide a document feeding system for an imaging apparatus with an imaging station and a document input stacking area, for unfolding and feeding to said imaging station an elongated web multi-sectional computer form document from a fan-folded stack thereof placed in said input stacking area, in a feeding direction extending generally from one end of said fan-folded stack towards said imaging station; the improvement comprising: a fan-folded computer form document unfolding assistance system, comprising a mounting system and a smoothly radiused fan-folded document unfolding assistance bar mounted to said mounting system and repositionable by said mounting system between a non-obstructing storage position and a stationary operating position overlying said document input stacking area; a detent system for detaining said fan-folded document unfolding assistance bar in said stationary operating position; and said stationary operating position of said fan-folded document unfolding assistance bar being in a selected fixed position substantially spaced above said document input stacking area and said fan-folded stack and extending over said stack substantially perpendicular to said feeding direction in a position which is intermediately overlying said stack spaced closer to said one end of said stack than from the opposite end of said stack, and positioned for otherwise unobstructed unfolding and feeding of said elongated web fan-folded document up and over said fan-folded document unfolding assistance bar towards said imaging station in said feeding direction.

Further specific features disclosed herein, individually or in combination, include those wherein said smoothly radiused fan-folded document unfolding assistance bar is a single and otherwise unobstructing generally cylindrical bar which is cantilever mounted by said mounting system free standing from only one end thereof from behind said fan-folded stack but extending horizontally at a preset stationary horizontal height out over said fan-folded stack in said operating position to allow unobstructed frontal stacking and unfolding of said fan-folded stack of said elongated web fan-folded document under said document unfolding assistance bar; and/or wherein said fan-folded document unfolding assistance bar is cantilever mounted on said mounting system with a vertical axis of rotation behind the rear side of said fan-folded stack of computer form web document to maintain a horizontal stationary operating position and to provide for rotation of said document unfolding assistance bar by approximately 90 degrees into a said non-obstructing storage position substantially parallel to but behind said fan-folded stack of said computer form web document; and/or said smoothly radiused fan-folded document unfolding assistance bar is a cylindrical bar with a radius of approximately 5 to 8 mm; and/or wherein said smoothly radiused fan-folded document unfolding assistance bar is mounted in said stationary operating position overlying said fan-folded stack spaced approximately 11 cm from said one end of said fan-folded stack in said feeding direction; and/or wherein said fan-folded document unfolding assistance bar is mounted in said stationary operating position overlying said fan-folded stack spaced approximately 5 cm above said fan-folded stack; and/or wherein said smoothly radiused fan-folded document unfolding assistance bar is a cylindrical bar with a radius of approximately 5 to 8 mm.

In general, in reproduction apparatus, such as xerographic and other copiers and printers, and scanners or multifunction machines, it is increasingly important to provide faster yet more reliable and more automatic handling of the physical image bearing sheets. It is desirable to reliably feed and accurately register document and/or copy sheets of a variety and/or mixture of sizes, types, weights, materials, humidity and other conditions, and susceptibility to damage. In particular, it is desirable to minimize misfeeding, skewing, jamming, wear or damage. The documents which may be handled may even have curls, wrinkles, tears, "dog-ears", cut-outs, overlays, tape, paste-ups, punched holes, staples, adhesive, slippery areas, or other irregularities. Sheets can vary considerably even if they are all of the same "standard" size. They may have come from different paper batches or have variably changed size with different age or humidity conditions, different imaging, fusing, etc... Avoidance of sheet skewing or other misregistration, or feed timing errors, is important for proper imaging. Otherwise, dark borders and/or edge shadow images may appear on the copy sheet, and/or information near an edge of the image may be lost. Sheet misregistration or misfeeding can also adversely affect further feeding, ejection, and/or stacking and finishing.

The terms computer form, CF or other such web document herein broadly refers to various conventional or other usually flimsy physical thin elongate sheets of paper or other suitable physical image substrates which are roll and/or web fed. The computer form web documents encompassed in the description and claims here can include web output documents from various data recorders, graphics printers or pen plotters as well as traditional CF line-printer outputs.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Various of the above-mentioned and further features and advantages will be apparent from the specific apparatus and its operation described in the example below, and the claims. Thus, the present invention will be better understood from this description of a specific embodiment, including the drawing figures (substantially to scale) wherein:

FIGS. 3 and 4 show identical schematic frontal views of the system of FIGS. 1 and 2 in web feeding operation, with FIG. 3 showing a snapshot of the CF web at a time when it is being unfolded and fed off the downstream end of the fan-fold stack, while FIG. 4 shows the (alternating) point in time when the unfolding and feeding of the web is from the upstream end of that stack;

Figure 5:
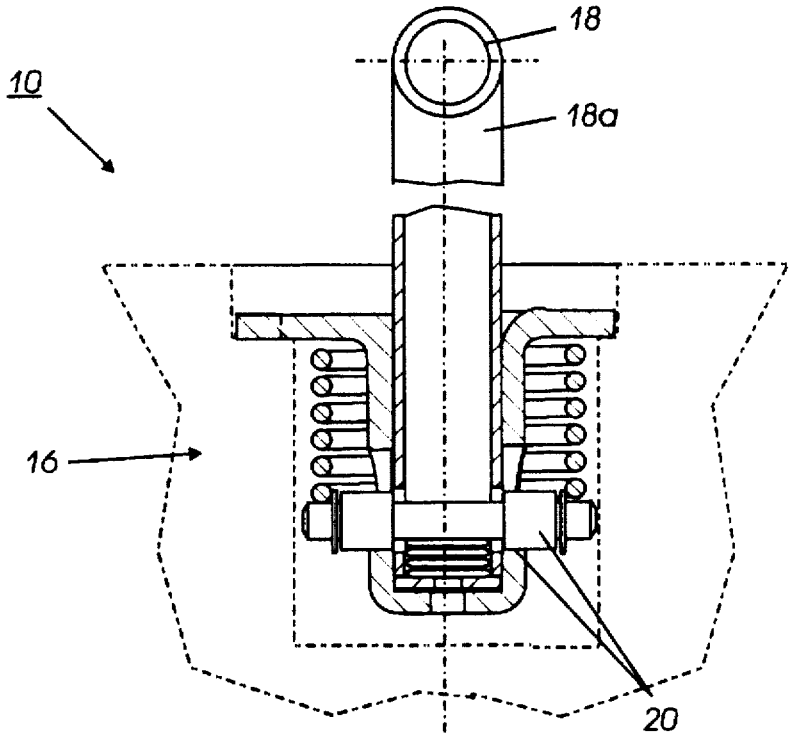
FIG. 5 is an enlarged partial frontal cross-sectional view of the mounting system per se of the system of FIGS. 1–4 in its operating position to illustrate the detent system therein.
Figure 6:
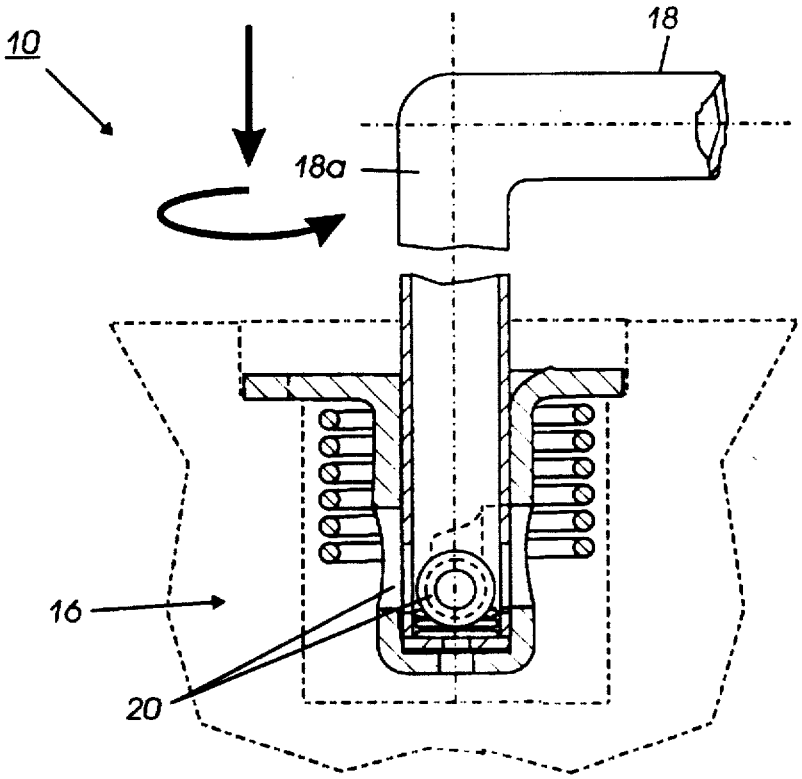
Figure 7:
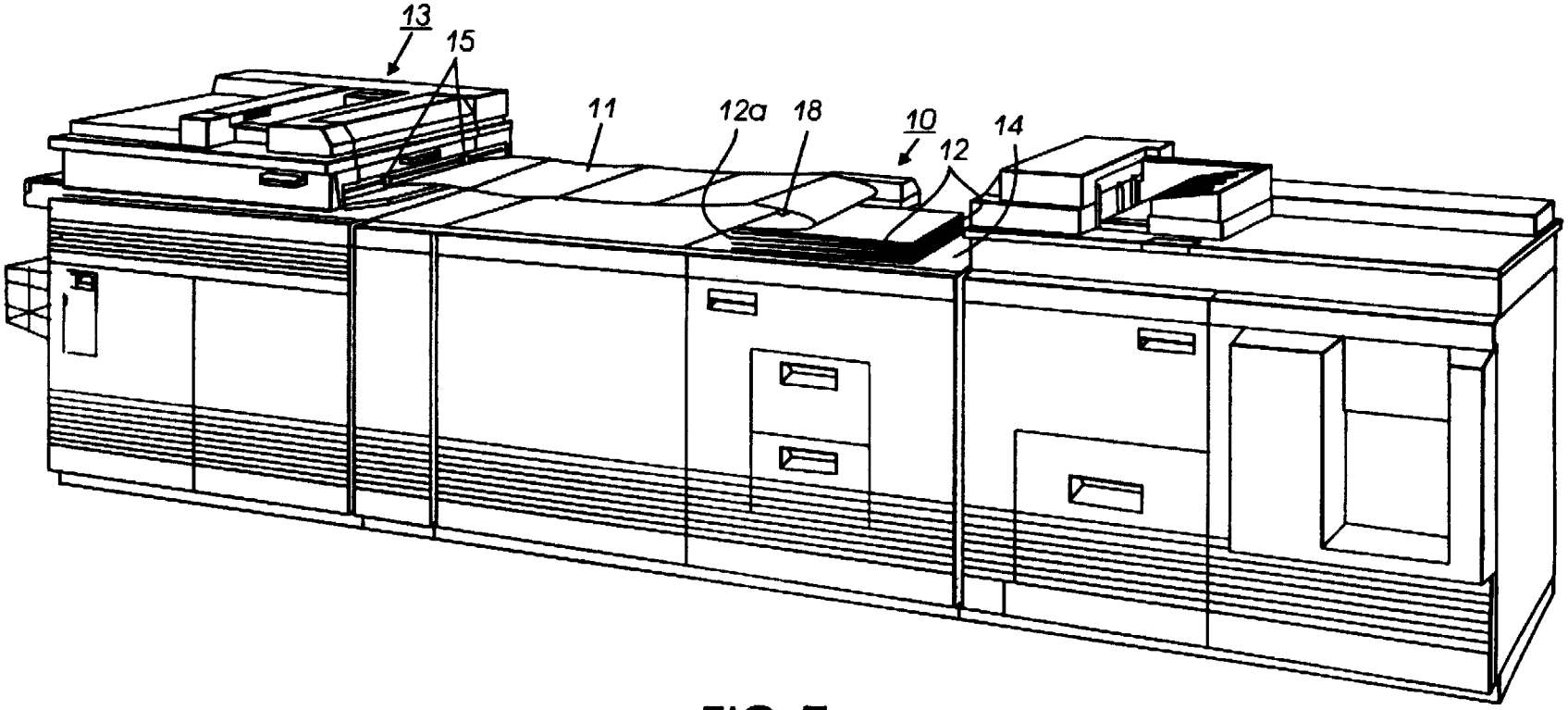

FIG. 6 is the same as FIG. 5 but with the system detented in its storage position; and FIG. 7 is a frontal perspective view of one example of an entire reproduction apparatus, showing one example of how the subject system of FIGS. 1–6 can be cantilever rear mounted on an upper surface of such a machine (on top of an interposer module in this particular example) to unfold and feed a CF web document to an existing conventional document feeding unit overlying a conventional imaging station platen.

Referring now to the computer form web document unfolding and feeding assistance system example shown in FIGS. 1–7, as noted, this can be mounted easily to the upper surface of any conventional imaging system or the document feeder thereon, or an adjacent module such as an inserter or interposer module or high capacity feeder attachment at one side of the document handler. Since all of the associated components are well known, commercially available and do not need to be modified in any way for use with the present system, they need not be described herein, and, in any case, examples thereof are disclosed and described in the above-cited U.S. Pat. No. 5,152,154 and SIR H17 and other art cited therein, various of which may be incorporated by reference. As shown therein, and in the FIG. 7 example, the imaging station to which the computer form web is fed for imaging may be the conventional platen imaging station, and the transporting of the document thereto from the fan-fold document input stack may be by the existing platen transport system of an existing overlying conventional document feeder. Alternatively, as shown for example in said SIR H17, the feeding of the CF web may be by a separate downstream computer form feeder pulling the web downstream over the imaging station, particularly if sprocket feeding of the web is desired and is provided for by sprocket holes in the webs. The present system is fully compatible with various such known CF web feeding systems.

There is disclosed here a computer form document unfolding assistance system 10 for improved unfolding a CF web 11 from a fan-folded stack 12 thereof which is placed in a fan-fold documents input stacking area 14. This input stacking area 14 is at one side of (upstream of) the imaging station document feeder 13 (example shown in FIG. 7) to which the web is to be fed for imaging. The CF web 11 is fed sequentially from the top of its fan-folded stack 12 with the unfolding and feeding assistance of the unfolding assistance system 10. The web 11 extends on from there to be pulled in a feeding direction extending generally from the downstream end **12*a* of the fan-folded stack 12 towards the imaging station document feeder 13. Since sheet input feeding rolls 15 of a document feeder such as 13 can be what the CF web 11 is initially fed into, and pulled by, these are shown per se for illustration simplicity in FIGS. 3 and 4**.

Figure 1:
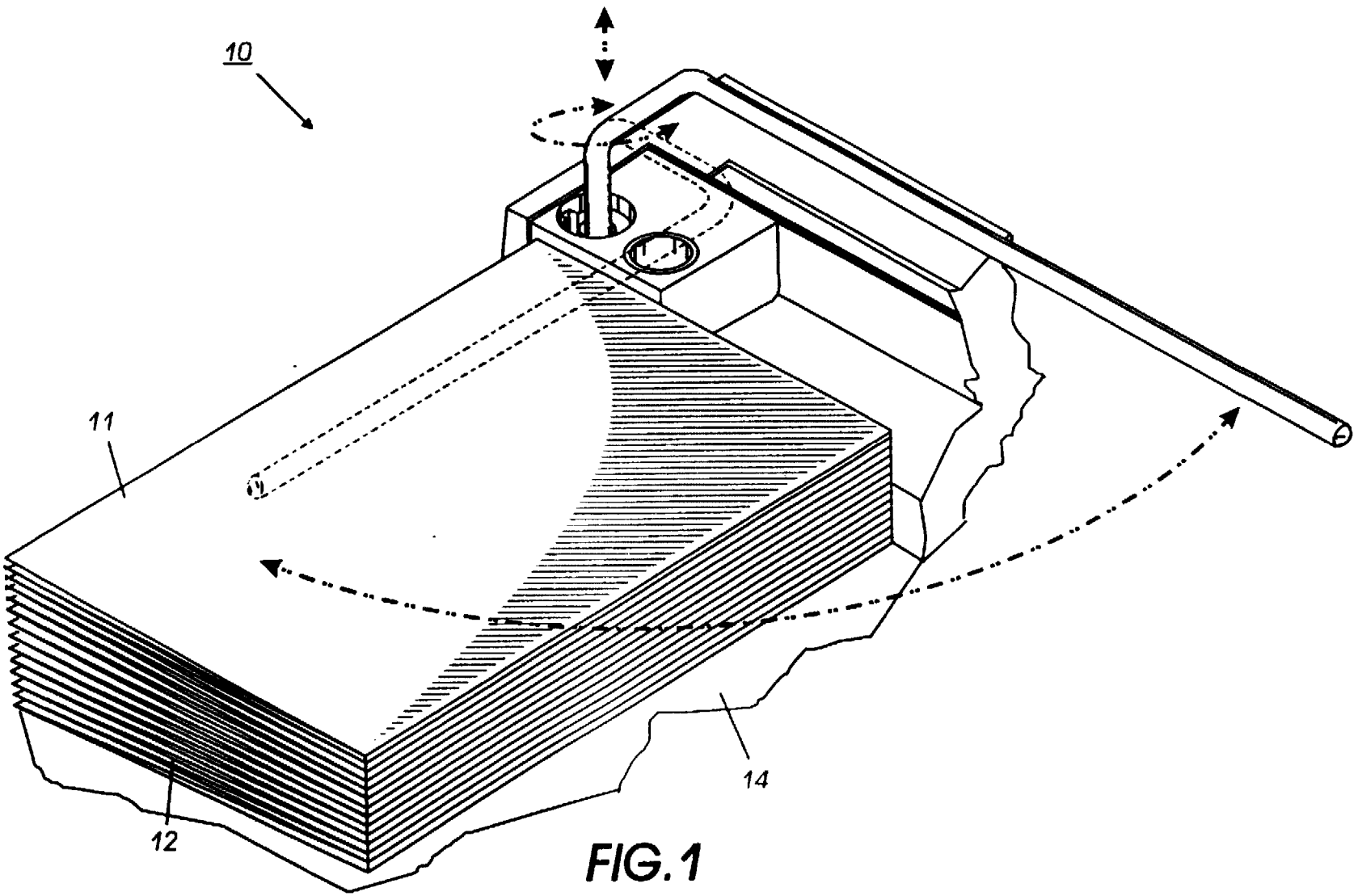
FIG. 1 is a frontal perspective view of an exemplary computer form document unfolding and feeding assistance system as one example of the subject invention, shown in its storage position, and also showing in phantom its operating position, with a movement arrow shown therebetween for its repositioning.
Figure 2:
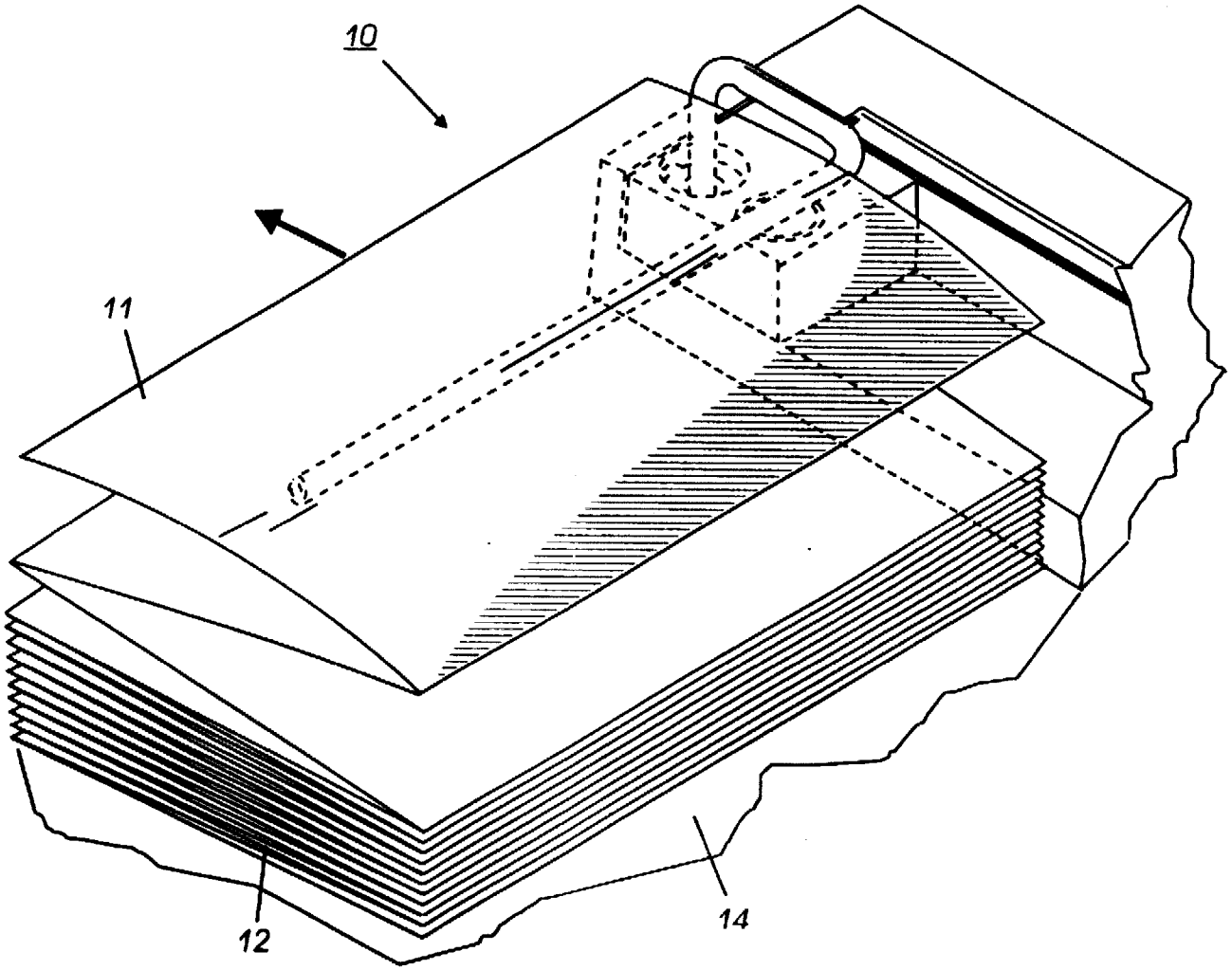
FIG. 2 is the same view as FIG. 1, of the fan-folded web document unfolding assistance system of FIG. 1, but shown in its operating position, with the leading end of a CF web to be imaged being initially started or threaded into this system from the illustrated fan-folded input stack of the CF web.

The fan-fold web unfolding and feeding assistance system example 10 here comprises a mounting system 16 which is pivotally and cantilever mounting the rear end portion **18*a* of a smoothly radiused fan-fold web unfolding assistance bar 18. This unfolding assistance bar 18 is repositionable by operator pivotal movement thereof between a non-obstructing storage position as shown in FIG. 1 and a stationary operating position overlying the document input stacking area 14 and the fan-folded stacked document 12 thereon as shown in FIG. 2. The mounting system 16, shown enlarged and in cross-section in FIGS. 5 and 6, here includes an integral detent system 20 with two detent positions, for holding the unfolding assistance bar 18 stationary in its operating position, and also in its non-obstructing storage position. The detent system 20 can be generally conventional, as shown, with extending small rollers (or pins) engaging respective mating "J" shaped detent recesses in an otherwise generally planar bearing surface, with a sufficiently high illustrated internal spring force to prevent the bar 18** from being inadvertently repositioned by movement of the CFF web thereover, yet relatively easily manually repositionable by the operator.

In the stationary operating position of the unfolding assistance bar 18, the bar 18 extends out horizontally in a selected fixed position substantially spaced above the document input stacking area 14. It has been found that the desired operating position of the bar 18 is overlying the fan-folded stack 12 by approximately 5 cm above the top of the stack, which stack may be 7 or 8 cm thick. Preferably, the unfolding assistance bar 18 web engagement portion is a cylindrical bar with a radius of approximately 5 to 8 mm. The bar 18 preferably extends over the stack substantially perpendicular to the feeding direction of the web. The bar 18 is intermediately located in that direction over the stack 12, but is spaced closer to the downstream or web feeding direction end 12*a* of the stack which is in the feeding direction than it is spaced from the opposite end of the stack 12. Specifically, preferably the unfolding assistance bar 18 is spaced approximately 11 cm upstream from the end 12*a* of the stack 12. The bar 18 is preferably a solid or hollow metal bar which is electrically grounded to the machine frame for removal or avoidance of static electricity in dry paper documents.

The above-specified preferred positions and dimensions have been found to provide as much as a 37% reduction in the drive forces of the downstream document handler needed to unfold the perforated edges of the fan-fold stack, as well as a significant noise reduction in the unfolding.

The mounting system 16 here maintains the bar 18 substantially horizontal and does not itself provide any obstruction to the frontal loading or feeding of the web document. As shown, there is nothing whatsoever underneath the bar 18 in the feeding area. The bar 18 is freestanding, being cantilever mounted from only one end 18*a* thereof from behind the fan-folded stack. This is provided here by an integral vertical bar end portion 18*a*, bent from the inside end of the bar 18, extending vertically down into the mounting system 16. This provides a vertical axis of rotation pivotal mounting of the entire bar 18. This vertical axis of rotation is concentric with the vertical portion 18*a* of the bar 18. That maintains the horizontal above-described stationary operating position of the bar 18, and also provides for rotation of that bar 18 by approximately 90° into the non-obstructing storage position, which, as shown in FIG. 1, is substantially parallel to, but rearwardly of, the entire area. Thus, the entire document unfolding assistance system 10 is completely out of the way, in its storage or non-operating position, yet can be rotated into its operating position easily by the user at any time.

It may be seen that as compared to above-cited prior art devices that require a movable U-shaped bar, a pivotal wall, a spring loaded dancer roll, or the like, which must be supported at both ends, the above-described advantages, including unobstructed front loading, can be provided. In addition, the present system has been found to cause less stack walk, increased operability latitude, reduced noise, have a much lower cost, and greater adaptability to various machines, modules and document handlers. There are no moving parts whatsoever during the operation of the present device. There is reduced impact sound in the web unfolding as compared with the pivoting bail system of the above-cited U.S. Pat. No. 5,152,514, and it is also insensitive to variations or increases in the speed of the web feeding. There is no interference with either the document handler or other mounting surface, and thus there is no limitation in the depth and width of the available document loading area for the fan-fold web.

Although not specifically illustrated herein, it will be appreciated that the mounting system 16 may also be adapted to provide vertical height adjustments of the bar 18. For example, by vertical height resetting of the vertical portion 18*a* with a telescoping mounting with set screws or other vertical detents. This will allow for adjustments in the vertical height of the horizontal portion of the bar 18 to accommodate different surface levels of the input stacking area 14 or the mounting system 16, and/or differences in the desired stack 12 thickness to be unfolded and fed.

Figure 3:
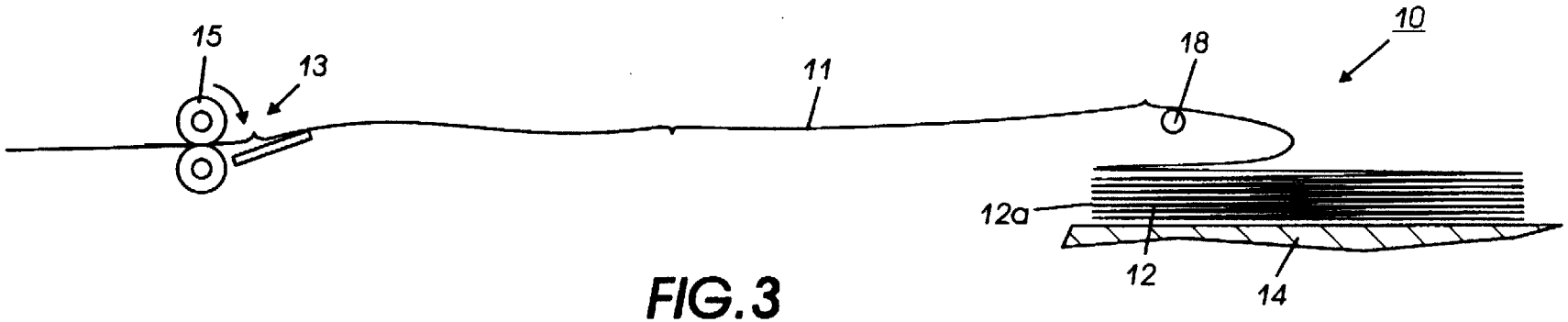
Figure 4:
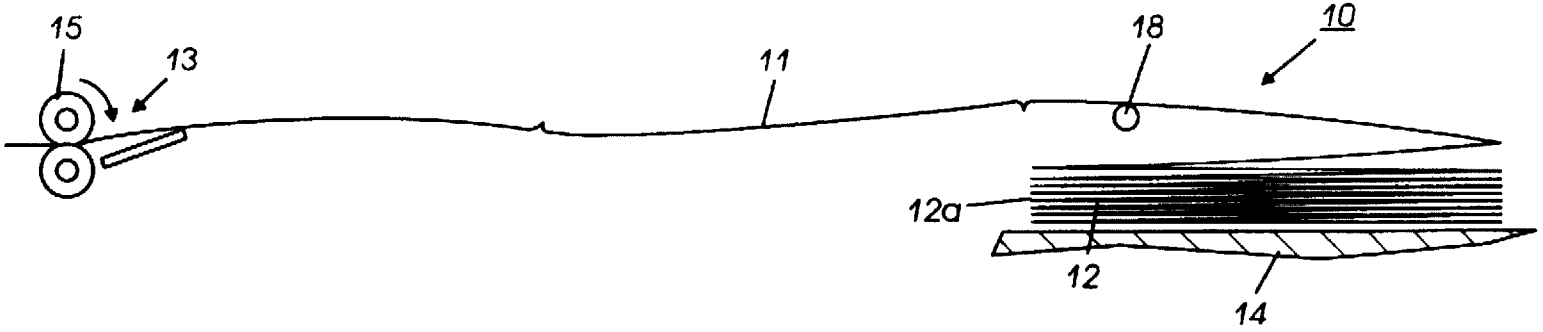

Note that with the present system, unlike the above-cited systems, when the fan-fold web is in a position which is unfolding the front or downstream edge of the web, the web is being guided by somewhat less than a 180° wrap around the bar 18, as shown in FIG. 3, and that bar is relatively large in diameter compared to the cited prior art systems. More importantly, the position of the bar 18 is closer to the stack edge 12*a*, rather than being centrally located, or located at one end of the stack, so that the downstream end 12*a* being unfolded is actually pulled upstream for a short distance as well as being lifted upwardly up and around the overlying bar 18. This results in a curling-up movement of the ends of the fan-fold stack as they are unfolding, rather than a direct vertical movement attempting to pull the downstream end of the stack up vertically.

This curling up or vertical movement begins to occur at the end of the feed cycle of the previous sheet (web segment) being incrementally fed. This is the point of the cycle when forces in the web 11 are lower as a result of the web 11 decelerating to its stop position. Thus, when the feed cycle begins for the sheet, and acceleration forces result in high web 11 forces, there is less resistance from the fold to feeding. In some forms of previous systems, feeding occurred in a more horizontal direction to a flat stack 14. Thus, the beam strength of the paper in the stack resisted the feed. With the bar 18 placed over the stack here there is a larger vector force in the vertical direction that is lifting the sheet up from the stack 14. This causes the sheet to curl off the stack 14. Thus, the beam strength of the paper shows little or no resistance to feeding. Also, eliminating the more horizontal feed and providing a more curling vertical feed has cut down on the "stack walking" phenomenon.

Some previous systems used spring loaded bars which resulted in the bar bouncing as the feed cycles accelerated and decelerated. This spring loading effect would make the system dynamically sensitive to feeding speed and cycle profiles. Here, the bar 18 when positioned for feeding offers a rigid support against the feeding web 11, eliminating those issues.

While the embodiment disclosed herein is preferred, it will be appreciated from this teaching that various alternatives, modifications, variations or improvements therein may be made by those skilled in the art, which are intended to be encompassed by the following claims:

We claim:

1. In a document feeding system for an imaging apparatus with an imaging station and a document input stacking area having front and rear facing sides, with an unfolding assistance system for unfolding and feeding to said imaging station an elongated web multi-sectional computer form document from a fan-folded stack thereof placed in said input stacking area in a feeding direction transversely of said front and rear facing sides extending generally horizontally from one end of said fan-folded stack towards said imaging station; wherein said document input stacking area and said imaging station are at substantially the same level, the improvement in said unfolding assistance system comprising:

a mounting system mounting said unfolding assistance system adjacent said rear side of said document input stacking area, a smoothly radiused document unfolding assistance bar cantilever mounted to said mounting system and horizontally rotatable on said mounting system between a non-obstructing storage position adjacent said rear side of said document input stacking area and a stationary operating position overlying said document input stacking area, and a detent system for detaining said document unfolding assistance bar in said stationary operating position, said stationary operating position of said document unfolding assistance bar being in a selected fixed position substantially spaced above said document input stacking area and said fan-folded stack and extending over said stack substantially perpendicular to said feeding direction in a position which is intermediately overlying said stack spaced closer to said one end of said stack than the opposite end of said stack and positioned for otherwise unobstructed unfolding and feeding of said elongated web computer form document up and over said document unfolding assistance bar towards said imaging station in said feeding direction.

2. The document feeding system unfolding assistance system for a computer form document of claim 1, wherein said smoothly radiused document unfolding assistance bar is a single and otherwise unobstructing generally cylindrical bar which is cantilever mounted by said mounting system free standing from only one end of said bar from behind said fan-folded stack but extending horizontally at a preset stationary horizontal height out over said fan-folded stack in said operating position to allow unobstructed frontal stacking and unfolding of said fan-folded stack of said elongated web fan-folded document under said document unfolding assistance bar.

3. The document feeding system unfolding assistance system for a computer form document of claim 1, wherein said document unfolding assistance bar is cantilever mounted on said mounting system with a vertical axis of rotation behind the rear side of said fan-folded stack of said computer form web document to maintain said bar horizontally in said stationary operating position and to provide for rotation of said document unfolding assistance bar by approximately 90 degrees into a said non-obstructing storage position substantially parallel to but behind said fan-folded stack of said computer form web document.

4. The document feeding system unfolding assistance system for a computer form document of claim 3, wherein said smoothly radiused document unfolding assistance bar is a cylindrical bar with a radius of between approximately 5 mm and 8 mm.

5. The document feeding system unfolding assistance system for a computer form document of claim 1, wherein said smoothly radiused document unfolding assistance bar is a cylindrical bar with a radius of between approximately 5 and 8 mm.

6. The document feeding system unfolding assistance system for a computer form document of claim 1, wherein said smoothly radiused document unfolding assistance bar is mounted in said stationary operating position overlying said fan-folded stack spaced approximately 11 cm from said one end of said fan-folded stack in said feeding direction.

7. The document feeding system unfolding assistance system for a computer form document of claim 1, wherein said document unfolding assistance bar is mounted in said stationary operating position overlying said stack spaced approximately 5 cm above said fan-folded stack.

* * * * *

UNITED STATES PATENT AND TRADEMARK OFFICE

CERTIFICATE OF CORRECTION

PATENT NO. : 5,755,399
DATED : May 26, 1998
INVENTOR(S) : Halvonik, et al

It is certified that error appears in the above-identified patent and that said Letters Patent is hereby corrected as shown below:

On the title page: Item [75] Inventors: should read --Mary Beth Bourdeau--.
Item [73] Assignee: should read --Corporation--.

Signed and Sealed this
Tenth Day of November 1998

*Attest:*

*Attesting Officer*

BRUCE LEHMAN

*Commissioner of Patents and Trademarks*